US005184681A

United States Patent [19]

Fontenot

[11] Patent Number: 5,184,681

[45] Date of Patent: Feb. 9, 1993

[54] TELESCOPING RISER JOINT AND IMPROVED PACKER THEREFOR

[75] Inventor: William L. Fontenot, Houston, Tex.

[73] Assignee: Cooper Industries, Inc., Houston, Tex.

[21] Appl. No.: 754,444

[22] Filed: Sep. 3, 1991

[51] Int. Cl.[5] ..... E21B 33/035; E21B 17/01

[52] U.S. Cl. ..... 166/367; 277/34.3

[58] Field of Search ..... 166/367, 359, 350, 82, 166/84; 277/34, 34.3, 34.6, 70, 72 FM, 75, 147

[56] References Cited

U.S. PATENT DOCUMENTS

| | | | |
|---|---|---|---|
| 2,071,197 | 2/1937 | Burns et al. | 277/34 |
| 2,176,355 | 10/1939 | Otis | 277/31 |
| 2,192,805 | 3/1940 | Seamark | 277/31 |
| 2,458,270 | 1/1949 | Humason | 417/90 |
| 2,746,709 | 5/1956 | Minor | 251/1.2 |
| 2,843,349 | 7/1958 | Meyer | 251/1.2 |
| 3,212,408 | 10/1965 | Randol | 277/34 X |
| 3,471,156 | 10/1969 | Burns et al. | 277/3 |
| 3,492,007 | 1/1970 | Jones | 277/31 |
| 3,815,926 | 6/1974 | Vore | 277/34 |
| 3,955,621 | 5/1976 | Webb | 166/359 |
| 4,632,403 | 12/1986 | Ishitani et al. | 277/34.3 X |

*Primary Examiner*—Stephen J. Novosad

[57] ABSTRACT

An improved riser telescoping joint including a riser mandrel, an annular resilient packer carried by the riser mandrel, a telescoping mandrel positioned within and movable with respect to said riser mandrel, a line connected to the riser mandrel for delivering fluid under a predetermined pressure against the exterior of said packer to cuase it to seal against the exertion of said telescoping mandrel and a restricted flow passage communicating from the exterior to the interior of the packer to supply a limited amount of said pressure fluid as a lubricant between the interior of the packer and the exterior of the telescoping mandrel.

4 Claims, 4 Drawing Sheets

TELESCOPING RISER JOINT AND IMPROVED PACKER THEREFOR

BACKGROUND

The present invention relates to a telescoping joint used at the top of a riser extending from a subsea wellhead to the surface which allows relative motion between the riser mandrel and the telescoping tubular mandrel and to an improved packer positioned between the riser mandrel and the telescoping mandrel. In prior risers telescoping joints have been used to provide such relative motion. Such telescoping joints have included resilient packers which include apparatus for the introduction of a fluid under pressure to exert a controlled force on the exterior of the packer to seal against the hydrostatic head of mud. In such prior structures the pressure introduced was controlled to allow a limited leakage of mud past the packers for lubrication purposes.

Recently specifications have been adopted which require telescoping joint packers to be able to seal against pressures up to 200 psi. Additionally, some operators are requesting that the telescoping joint packers have the ability to seal against pressures up to 500 psi. Such high sealing pressures exerted on the resilient packer prevents any lubricating leakage of mud past the packing. This results in high packer wear rates and in some extreme cases may prevent the relative motion between the telescoping mandrel and the riser mandrel.

U.S. Pat. Nos. 2,071,197, 2,746,709, 2,,843,349 and 3,492,007 all disclose blowout preventers for use on a well in which the packer is activated into its sealing position responsive to fluid pressure applied thereto.

U.S. Pat. No. 2,176,355 discloses a drilling head having an annular resilient packer sleeve which is adapted to close around a kelly when it is exposed to external pressure.

U.S. Pat. No. 2,192,805 discloses casing head seals in which pressure is supplied through an annular metal sleeve to the exterior of an annular flexible packer to provide sealing against the string extending therethrough.

U.S. Pat. No. 1.458,270 discloses a flexible seal which is inflated to be a wiper seal against the exterior of a pump rod.

U.S. Pat. No. 3,471,156 discloses an inflatable packing for a stuffing box in which the interior of the packing is provided with a plurality of annular recesses to provide a plurality of lip seals which seal against the rod extending through the box.

None of this prior art suggests any structure which is similar to the improved structure of the present invention nor do they have any appreciation of the problem which has been solved by the present invention of providing a high pressure seal without excessive friction and wear as hereinafter explained.

SUMMARY

The present invention relates to an improved telescoping joint which can seal against very high pressures without causing excessive wear or preventing relative motion of the joint. The improved telescoping joint includes a riser mandrel, a telescoping mandrel, a resilient annular packer carried by the riser mandrel and positioned to span the annulus between the exterior of the telescoping mandrel and the interior of the riser mandrel to seal against such surfaces, means for introducing a fluid under pressure against the exterior of the resilient packer to force it into sealing engagement with the telescoping mandrel surface, and means for allowing a controlled amount of the fluid introduced against the exterior of the resilient packer to the interior of the packer to provide lubrication between the resilient packer and the exterior surface of the telescoping mandrel.

An object of the present invention is to provide an improve telescoping joint for a riser which provides a pressure energized seal against substantial pressures without creating excess friction between the packer and the surface against which it is to seal.

Another object is to provide an improved resilient annular packer seal for a riser telescoping joint which exerts substantial sealing pressure without creating friction forces which would normally result from such sealing pressures.

A further object is to provide an improved telescoping riser joint which seals against substantial pressures but is not prevented from moving responsive to such sealing pressure.

Still another object is to provide an improved telescoping riser joint which has a packer which seals against substantial pressures but is not subject to excessive wear of the sealing packer.

BRIEF DESCRIPTION OF THE DRAWINGS

These and other objects and advantages are hereinafter set forth and explained with respect to the drawings wherein.

DESCRIPTION OF THE PREFERRED EMBODIMENT

Figure 1:
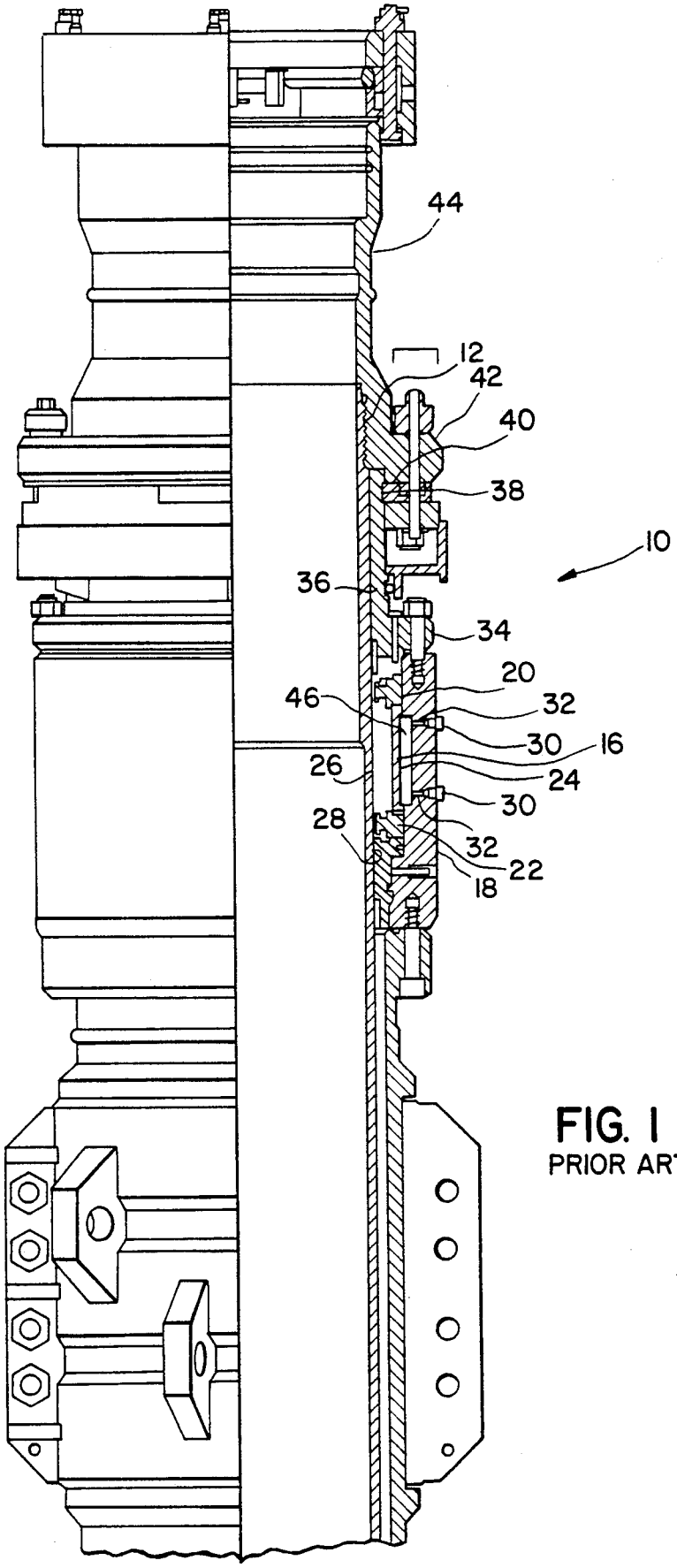
FIG. 1 PRIOR ART
FIG. 1 is an axial sectional view of the top portion of a riser mandrel and telescoping joint of the prior art.
Figure 2:
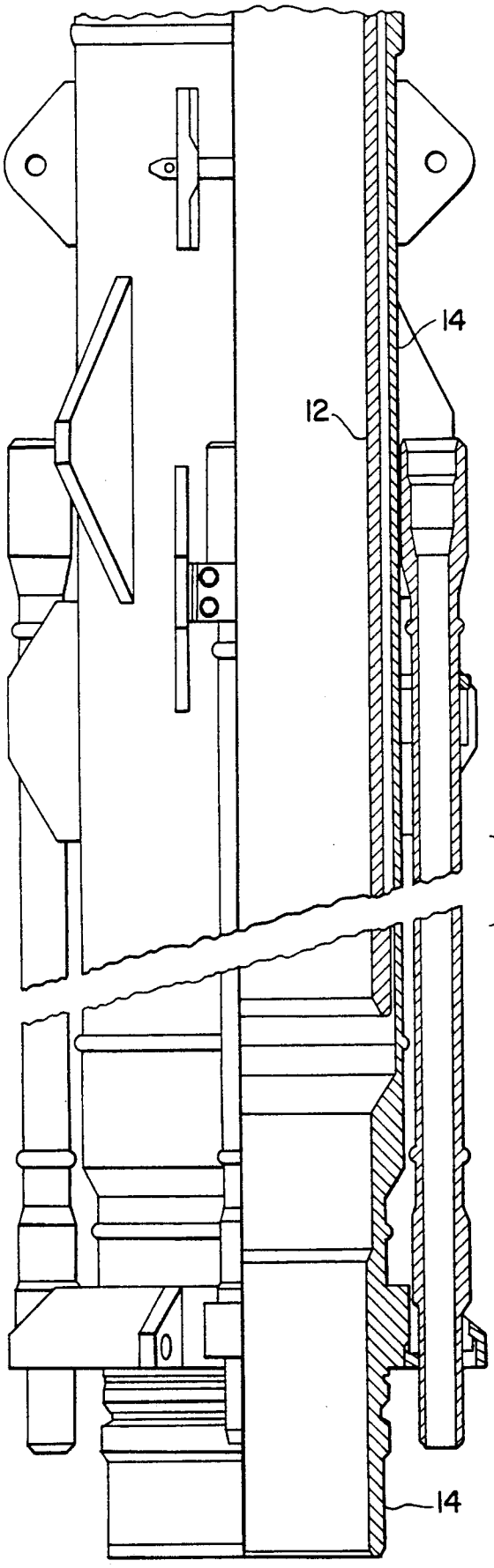
FIG. 2 PRIOR ART
FIG. 2 is a similar sectional view of the lower portion of the structure shown in FIG. 1.

In FIGS. 1 and 2 telescoping joint 10 of the prior art includes upper telescoping mandrel 12 and the upper end of riser 14 which is in surrounding relationship to mandrel 12. Resilient annular packer 16 is positioned within packer housing 18. Upper ring 20 and lower ring 22 are molded in annular packer 16 as shown with tubular member 24 positioned between said rings. The exterior surface of packer 16 is positioned against the inner surface of tubular member 24 and the interior surface 26 of packer 16 has a diameter for sealing against the exterior surface 28 of the upper end of mandrel 12. Pressure fittings 30 connect into the ports 32 extending through housing 18. Housing 18 is secured at its lower end to riser 14 and at its upper end to flange 34 on tubular member 36. Tubular member 36 includes exterior groove 38. Eccentric locks 40 are supported from flange 42 so that they can be rotated into groove 38 or out of groove 38. Flange 42 is the lower portion of tubular member 44 which supports mandrel 12.

When joint 10 is installed and properly supported with mandrel 12 extending through the upper interior of riser 14, then eccentric locks 40 are rotated out of their locking positions in groove 38 and fluid under pressure is delivered through fittings 30 and ports 32 into the annular chamber 46 surrounding tubular member 24. Such pressure is sufficient to cause annular packer 16 to be urged inwardly into sealing engagement with exterior surface of mandrel 12.

Trouble is encountered with this prior art structure when the pressure applied into annular chamber 46 is increased to levels not contemplated by the design of such structures. In such cases the excessive sealing pressure causes the normal well fluids to be excluded so that there is no lubrication between the packer 16 and the exterior of mandrel 12. This can cause excessive wear of the packer material and can be sufficient to prevent relative movement between mandrel 12 and riser 14. Under these conditions the structure of the prior art is not satisfactory.

Figure 3:
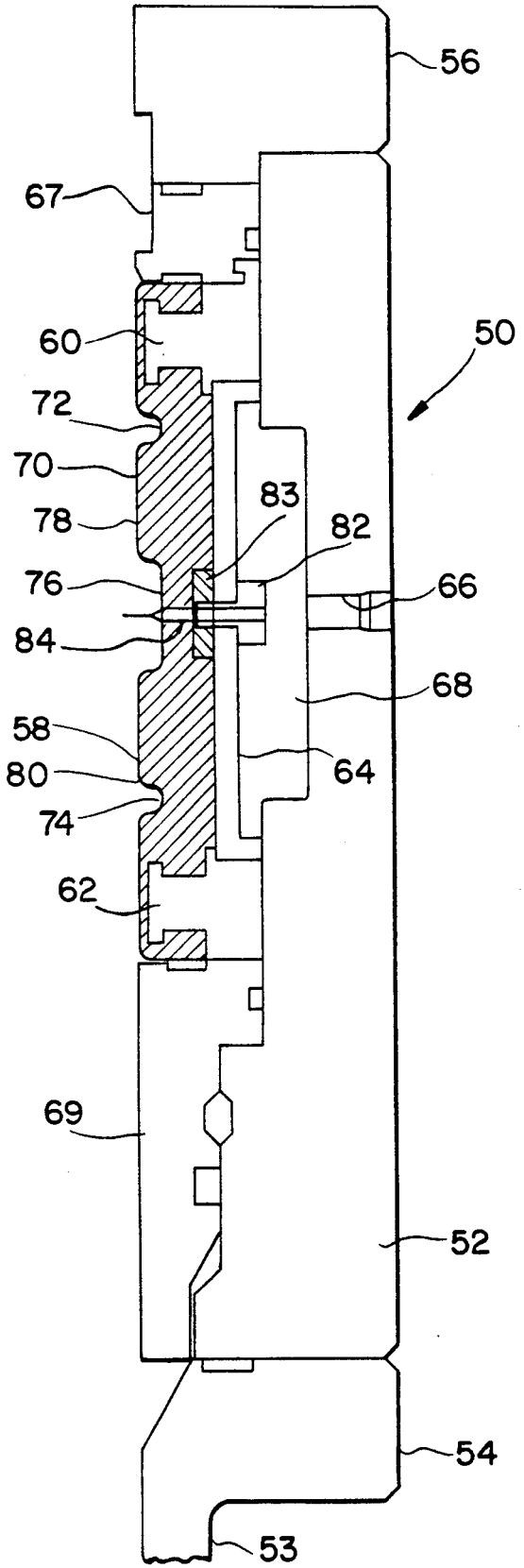
FIG. 3 is a partial detailed sectional view of the improved packer structure of the present invention which is installed in a telescoping joint such as shown in FIGS. 1 and 2 in place of the packer structure illustrated therein.

The improved telescoping joint of the present invention is identical to joint 10 except that an improved packer structure 50 is provided as shown in FIG. 3. Packer housing 52 is secured to lower flange 54 on the top of tubular housing 53 which is secured to the top portion of the riser (not shown) and to upper flange 56 which is releasably connected to the upper structure supporting the telescoping mandrel (not shown). Resilient annular packer 58 includes upper ring 60 and lower ring 62 molded therein. Sleeve 64 is positioned on the exterior surface of packer 58 and between rings 60 and 62. Port 66 extends through housing 52 to conduct fluid under pressure into chamber 68 between the interior of housing 52 and the exterior of sleeve 64. Upper support ring 67 and lower support ring 69 are positioned above and below packer 58 within housing 52 as shown. The inner surface 70 of packer 58 includes upper groove 72, lower groove 74, central groove 76 with upper land 78 and lower land 80 between the grooves as shown. Fitting 82 is threaded into place 83 which is molded into packer 58 and has a control orifice therein, preferably with suitable filters, and communicates with a plurality of openings 84 extending through packer 58 into its interior within central groove 76.

With the fluid used to pressurize packer 58, a small amount is delivered through fitting 82 into central groove 76 and provides lubrication between the interior of packer 58 and the exterior surface of the telescoping mandrel. With this small amount of lubrication, the problems of packer wear and excessive frictional resistance to the movement of the telescoping mandrel are avoided.

Figure 4:
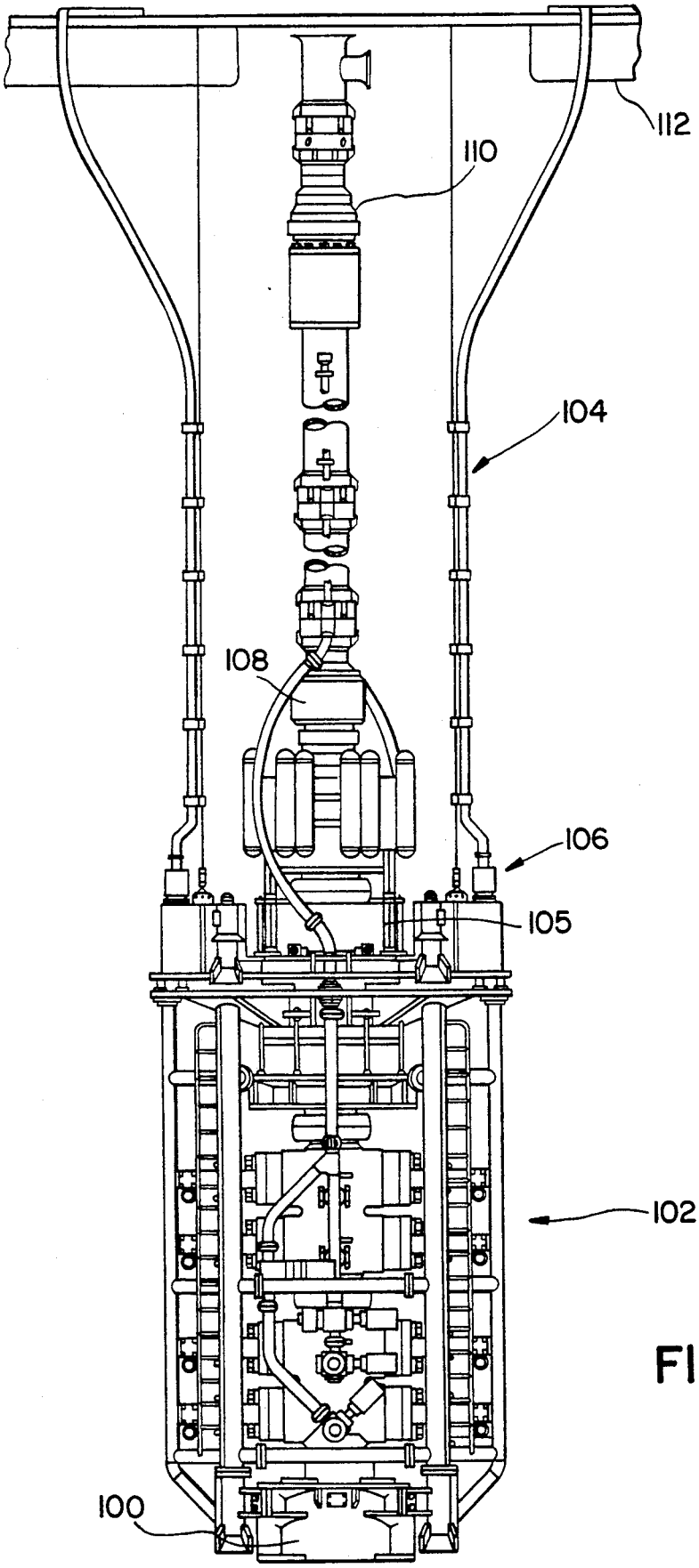
FIG. 4 is an elevation view of the environment in which the improved structure of the present invention is used.

In service the improved telescoping joint of the present invention is shown in FIG. 4 in the connection with the equipment extending from a subsea wellhead to a drilling vessel 112. As shown, wellhead collect connector 100 is provided on the lower end of the blowout preventer stack 102 for connecting to the wellhead (not shown). Riser system 104 includes the riser collet connector for connecting the upper end of blowout preventer stack 102 to riser stab system 106. Ball joint 108 is positioned between the upper end of riser stab system 106 and the riser system 104. Telescoping joint 110 of the present invention having the improved packer structure previously described, is connected into riser system 104 at its upper end as shown.

As previously described, the improved telescoping joint of the present system provides pressure energization of the seal against substantial pressures without creating excess friction between the packer and its sealing surface. This allows freedom of movement of the telescoping joint which is needed without sacrificing the sealing need between its telescoping members.

What is claimed is:

1. A riser joint comprising a riser tubular mandrel having an upper end, a telescoping mandrel positioned for axial movement within the upper end of said riser tubular mandrel, a resilient annular packer carried on the interior of the riser mandrel, means for delivering a fluid under substantial pressure against the exterior of said annular packer to cause it to seal against the exterior of said telescoping mandrel, and means for conducting a predetermined small amount of the fluid under pressure to the interior of said packer to provide lubrication for the movement of said telescoping mandrel thereagainst.

2. A riser joint according to claim 1 wherein said delivering means includes an opening through said riser housing to communicate with the exterior of said annular packer.

3. A riser joint according to claim 1 wherein said conducting means includes a restricted passage through said annular packer to allow a small amount of fluid to pass therethrough to provide lubrication for the relative movement of said telescoping mandrel with respect to said annular packer.

4. A riser joint according to claim 1 wherein said annular packer includes at least one internal groove, and fluid conducted through said packer is discharged into said groove.

* * * * *